United States Patent [19]

Pullinen

[11] Patent Number: 4,523,978

[45] Date of Patent: Jun. 18, 1985

[54] FORMING SHOE FOR A FORMER IN A PAPER MACHINE

[75] Inventor: Martti Pullinen, Jyväskylä, Finland

[73] Assignee: Valmet Oy, Finland

[21] Appl. No.: 490,043

[22] Filed: Apr. 29, 1983

[30] Foreign Application Priority Data

Apr. 30, 1982 [FI] Finland ..... 821531

[51] Int. Cl.[3] ..... D21F 1/36

[52] U.S. Cl. ..... 162/300; 162/301; 162/352; 162/354

[58] Field of Search ..... 162/273, 300, 301, 352, 162/354, 203

[56] References Cited

U.S. PATENT DOCUMENTS

| | | | |
|---|---|---|---|
| 3,027,940 | 4/1962 | Dunlap | 162/352 |
| 3,323,981 | 6/1967 | Heys | 162/352 |
| 3,994,774 | 11/1976 | Halme et al. | 162/273 |
| 3,997,390 | 12/1976 | Kankaanpaa | 162/273 |
| 4,033,812 | 7/1977 | Riihinen | 162/273 |
| 4,146,424 | 3/1979 | Justus | 162/273 X |
| 4,154,645 | 5/1979 | Kankaanpaa | 162/133 |
| 4,417,950 | 11/1983 | Bubik et al. | 162/352 |

FOREIGN PATENT DOCUMENTS

| | | | |
|---|---|---|---|
| 3204465 | 9/1982 | Fed. Rep. of Germany | 162/348 |

OTHER PUBLICATIONS

Koskimies et al., "A Drainage Model for the Forming Zone of a Two-Wire Former", *Papper Och Tra* 1972 No. 4, pp. 137–146.

Hauptmann and Mardon, "The Hydrodynamics of Curved Wire Formers" *Pulp and Paper Magazine of Canada* vol. 74, No. 2, (Feb. 1973), pp. 72–77.

*Primary Examiner*—William Smith
*Assistant Examiner*—K. M. Hastings
*Attorney, Agent, or Firm*—Steinberg & Raskin

[57] ABSTRACT

A forming shoe in a two-wire forming section of a paper making machine has a curved guiding surface which guides a joint run of the wires and web interposed therebetween over a curved path of travel wherein the web is dewatered under the effect of the pressure between the wires at least in a direction away from the forming shoe, the dewatering action being assisted by the curvature of the forming shoe due to centrifugal forces. According to the invention, the length of the active portion of the forming shoe guiding surface, the surface quality or characteristics of the guiding surface and/or the radius of curvature of the guiding surface are adjustable so that web formation and the dewatering capacity of the forming shoe are controlled. For this purpose one or more devices are coupled to the forming shoe by which the attitude and/or location thereof is adjustable. In one embodiment a device is provided between the frame of the forming section and that of the forming shoe for pivoting the forming shoe about a horizontal axis and/or displacing the forming shoe linearly with respect to the vertical and/or horizontal plane.

18 Claims, 6 Drawing Figures

FORMING SHOE FOR A FORMER IN A PAPER MACHINE

BACKGROUND OF THE INVENTION

The present invention relates in general to paper making machines and, more particularly, to a two-wire forming section of a paper making machine including a forming shoe having a curved guiding surface for guiding the joint run of the forming wires and web interposed therebetween over a curved path of travel whereby dewatering of the web takes place in the region of the forming shoe at least in the direction away from the forming shoe, the dewatering being assisted by centrifugal forces arising from the curvature of the forming shoe.

It is well known in the art of paper making machines that the dewatering of a web being manufactured on a standard Fourdrinier paper machine is entirely in the downward direction, whereby fines and fillers depart from the wire side of the web due to the washing action of foils or table rolls. For this reason, the two sides of a web manufactured on a standard Fourdrinier machine exhibit anisotropic properties, the topside of the web having a greater smoothness and containing greater amounts of fines and fillers, while a lesser amount of fines and fillers are present on the wire side of the web. Moreover, the wire side of the web is often subjected to marking as is well known. For these reasons, paper manufactured by means of two-wire forming sections is considered preferable, particularly as regards its printability characteristics.

Two-wire forming sections are known in the art which do not include stationary dewatering elements. However, such conventional two-wire formers give rise to poor web formation since, among other reasons, there is no provision for pulsations of the dewatering pressure which have been found to contribute to better web formation. It is a further drawback of these conventional machines that it is not possible to control the relative proportions of dewatering through the upper and lower wires, respectively. It has been stated that such control would be desirable.

Two-wire forming sections which incorporate so-called forming shoes as stationary dewatering elements are also known. Such forming shoes are generally fixed in position. The conventional forming shoes usually present a guiding surface facing the wire having the same structure over its entire length in the direction of travel of the joint run. A forming shoe of this type has been found to operate in an optimal manner only at one particular speed of the paper machine and for one particular brand of paper being manufactured.

Regarding the state of the art to which the present invention pertains, reference is made to U.S. Pat. No. 4,154,645, issued May 15, 1979 wherein a method and web-forming unit for manufacturing multi-ply cardboard are disclosed and wherein a forming shoe is provided on the two-wire run. The guiding surface of the forming shoe has an open and closed construction wherein the length of the open and closed guiding surface is arranged to be adjustable by means of filler lists so that a slitted surface of the forming shoe can be converted into a totally closed guiding surface. This forming shoe is specifically intended for manufacturing multi-ply cardboard and it is noted that the position of the shoe cannot be adjusted.

Recently, planar wire machines have been modernized by rebuilding or retrofitting them by arranging one or more upper wire units over the planar wire unit in order to achieve a dewatering of the web in an upward direction so as to both increase the dewatering capacity as well as to improve both the formation and retention characteristics. An increase in the dewatering capacity enables the speed of the paper machine to be increased. Moreover, such constructions also enable the concentration of the pulp stock supplied from the headbox to be reduced which is advantageous in itself. In certain instances, old and slow newsprint machines have been modernized by the provision of such upper wire units to enable them to operate as cardboard machines without increasing the machine speed.

SUMMARY OF THE INVENTION

It is an object of the present invention to provide a new and improved forming shoe for a two-wire web forming section, which may constitute a single-wire forming section which has been rebuilt or modernized through the provision of an upper wire unit, by which better web formation is achieved.

Another object of the present invention is to provide a new and improved forming shoe for a two-wire web forming section for obtaining a dewatering of a web by which the distribution of fillers and fines in the web can be influenced.

Still another object of the present invention is to provide a new and improved forming shoe for a two-wire web forming section by which the two-wire dewatering zone is controlled to provide better support and a greater degree of stability for the wire runs than has been previously possible. This object has as its aim an improvement in web formation and the reduction of web streaking caused by folding of the web due to an unstable run of the wires.

Still another object of the present invention is to provide a new and improved forming shoe by which the former section of the paper machine can be controlled to operate in an optimally efficient manner from the viewpoints of both dewatering capacity as well as web formation at various paper machine speeds and for different paper types. Thus, in two-wire forming sections, a significant part of the dewatering action takes place in the region of the forming shoe and, therefore, the forming shoe has a large potential for influencing both the dewatering capacity of the forming section as well as the web formation. However, prior to the present invention, this potential has not been recognized other than to an extremely limited extent. It should also be noted that the forming shoe functions as a component for guiding the joint run of the wires so as to thereby contribute in itself to the stability of the run of the wires.

Briefly, in accordance with the present invention, these and other objects are attained by providing a forming shoe including a curved guiding surface having an active portion, i.e., a portion which guides the joint run of the wires and web interposed therebetween over a curved path of travel, whose length, surface quality or characteristics, and/or radius of curvature are adjustable for controlling the formation of the web and/or the dewatering capacity of the forming section. The means for adjusting the properties of the active portion of the curved guiding surface are constituted by movement activating means by which the attitude of the forming shoe and/or its position are adjustable in accordance with the requirements imposed by the speed of the paper machine and/or the quality of the paper being manufactured.

As regards the theory of dewatering which takes place in a two-wire curved forming zone, reference is made to the following publications: "Papper och Tra 1972" No. 4, pp. 137–146; Jouni Koskimies, Jorma Perkinen, Heiklki Puolakka, Eero Schultz, Bjorn Wahlstrom: "A Drainage Model for the Forming Zone of a Two-Wire Former"; and Pulp and Paper Magazine of Canada, Vol. 74, No. 2/ February 1973, pp. 72–77; E. Hauptmann and J. Mardon: "The Hydrodynamics of Curved Wire Formers".

The advantages provided by the present invention are indeed significant. Thus, a forming shoe constructed in accordance with the present invention achieves better web formation than has been possible heretofore. The dewatering action can be controlled both as to its quantity as well as with respect to the proportions of dewatering from the respective sides of the web, through the positional adjustment of the curved dewatering shoe. Suction may be employed inside the shoe if required. The present invention also makes it possible to control the dewatering capacity of the forming shoe and even the direction of dewatering through a suitable selection of the radius of curvature of the curved guiding surface or by providing an appropriate change in the radius of curvature in either a continuous or stepwise fashion, and by the aforementioned adjustment of the position and attitude of the forming shoe.

Moreover, when the forming shoe of the invention is applied in a forming section including a single-wire initial portion, it becomes possible to control the amount of dewatering which takes place on that single-wire initial portion within wider limits than has been possible heretofore. Accordingly, a more appropriate amount of dewatering in an upward direction through the upper wire will take place in the twin-wire portion.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
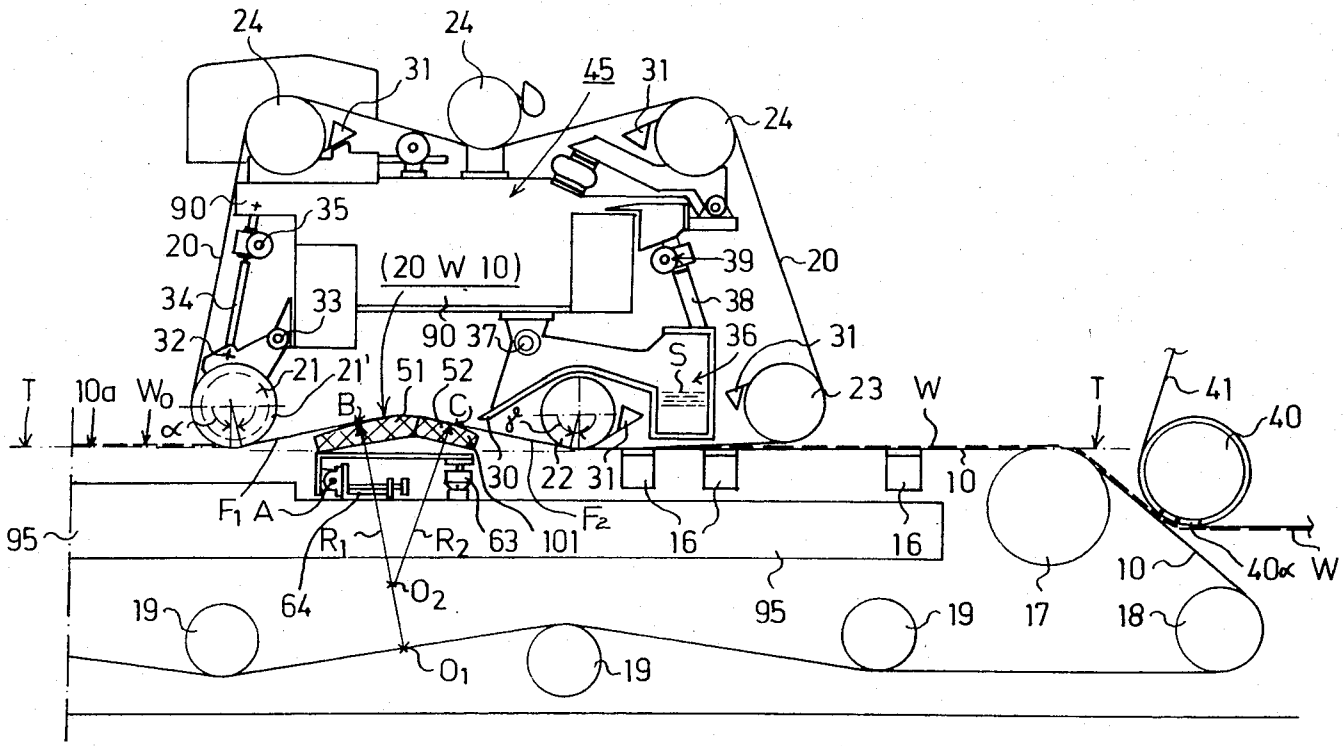
FIG. 1 is a schematic elevation view of a two-wire forming section comprising a rebuilt or modernized single-wire forming section incorporating a forming shoe in accordance with the present invention.

Referring now to the drawings wherein like reference characters designate identical or corresponding parts throughout the several views, and more particularly to FIG. 1, an embodiment of the invention is shown in connection with a single-wire forming section which has been rebuilt or modernized to include a two-wire forming section. More particularly, the plane of an originally planar wire 10 is designated T—T. The original forming section comprises the old wire section frame 95, the planar suction boxes 16, the wire suction roll 17, a traction roll 18, and guide rolls 19 guiding the lower run of the wire 10.

In the modernization of the planar wire section, a forming shoe 101 constructed in accordance with the present invention is mounted on the original frame part 95. The forming shoe 101 includes a curved guiding surface having a forward portion having a radius of curvature $R_1$ and a following subsequent portion having a radius of curvature $R_2$. The centers of curvature of the forward and subsequent portions of the curve guiding surface are designated $O_1$ and $O_2$, respectively.

The upper wire unit, designated 45, comprises a frame part 90 to which the various component parts of the upper wire unit are mounted. The run of an upper wire loop 20 is guided from the initial part of the two-wire section by an open forming roll 21 provided with a recessed surface 21', thereafter by the forming shoe 101 constructed in accordance with the invention, and by a first return roll 22 situated within the upper wire loop 20 and which directs the joint run of the wires 10, 20 and web interposed therebetween back into the original plane T—T of the lower wire 10. The two-wire dewatering zone terminates at a point somewhat forwardly of the traction roll 23 of the upper wire 20. The topside guide rolls of the upper wire 20 are designated 24. The rolls 22, 23 and 24 are provided with respective doctors 31. Moreover, the roll 21 is also preferably provided with a suitable cleaning device and water collecting means which are known in the art and which are not shown for the sake of clarity.

The single-wire initial portion **10*a* of the dewatering zone is constituted by the original wire 10 situated in the plane T—T and extends prior to or upstream of the two-wire portion. Dewatering takes place on the single-wire initial portion 10*a* by means of dewatering elements which formed a part of the original planar wire section, such as a breast roll and foil lists, which need not necessarily be replaced during the modernization of the original machine. A downward dewatering of the web takes place on the single-wire initial portion 10*a* through the lower wire 10. The initial dewatering takes place in a cautious manner to preserve the good formation and retention characteristics of the web and so that a sufficient amount of water remains in the web for a subsequent dewatering in the upward direction in the two-wire section. However, when applied in the manner shown in FIG. 1**, the single-wire initial part of the wire section has a length such that when dewatering is cautiously performed in this initial part the pulp web has time, before the double wire part, to achieve a degree of felting such that the fibers are no longer able to move appreciably with reference to each other. Thus, a fiber network or mat is obtained on the single-wire initial part of the forming section.

The joint run of the wires 10 and 20 curve upwardly over the sector $\alpha$ of the roll 21. The sector $\alpha$ preferably has a size in the range of between about 5° to 45°, and most preferably is about 20°. A dewatering pressure is achieved on the sector $\alpha$ due to the tension created between the wires 10 and 20 so that dewatering takes place both upwardly and downwardly, the centrifugal forces promoting the dewatering from the open surface 21' of the roll 21 after the zone of tension over sector $\alpha$.

The forming shoe 101 of the embodiment of FIG. 1 comprises a first forward part 51 and a second subsequent part 52. The parts 51 and 52 define respective curved guiding surface portions, the first guiding surface portion of part 51 having a radius of curvature $R_1$ which is larger than the radius of curvature $R_2$ of the curved guiding surface portion of part 52. When in the position illustrated in FIG. 1, the forming shoe 101 guides the joint run of the wires 10 and 20 between the lines B and C, the line B being located in the region of the first guiding surface portion of part 51 having the radius of curvature $R_1$ while the line C is located in the region of the second guiding surface portion of part 52 having the radius of curvature $R_2$. The guiding surface portions of the parts 51 and 52 of forming shoe 101 comprise solid-cover surfaces and the regions of the guiding surfaces between lines B and C constitute the active portion of the guiding surface of the forming shoe. The active portion of the forming shoe 101 thus has solid-cover surface qualities or characteristics.

As shown in FIG. 1 and in accordance with the invention, movement activating means 63 and 64 are provided for adjusting the position and/or attitude of the forming shoe 101. More particularly, the movement activating means 63, which may for example be constituted by a worm transmission, is operatively associated with the forming shoe 101 to pivot or swivel the latter about a horizontal axis A. The movement activating means 64, which may also incorporate a worm transmission, is associated with the forming shoe 101 to adjust the position thereof in a horizontal plane. Through suitable adjustment of the movement activating means 63 and 64, the length and position of the active portion B-C over which the two-wire dewatering zone curves, is adjustable. Through such adjustment, the lengths and magnitudes of the straight runs $F_1$ and $F_2$ of the wires 10, 20 will also be adjusted. Moreover, it is also possible through suitable adjustment of the movement activating means 63 and 64 to influence the manner in which the first and second guide surface portions of parts 51 and 52, having respective different radii of curvature, guide the joint run of the wires 10 and 20. In this connection, the extreme positions of the forming shoe will be those in which the lines B and C are located entirely on the region of the first guide surface portion of part 51 or on the region of the second guide surface portion of part 52. By providing such a wide range of adjustment for the position of forming shoe 101, the dewatering capacity of the forming section as well as web formation can be decisively influenced.

A straight joint run $F_2$ of the wires 10 and 20 in an oblique downward direction follows the trailing line C of the active portion of the guiding surface of shoe 101. Thereafter, the roll 22 guides the joint run of the wires 10 and 20 upwards on a sector $\gamma$ to join the original plane T—T of the lower wire 10.

The web is eventually detached from the lower wire 10 on a downwardly oblique run between the rolls 17 and 18 under the effect of a suction zone 40$\alpha$ of the pick-up roll 40 and is transferred onto a pick-up fabric 41 which carries the web onward to the press section (not shown).

Figure 2:
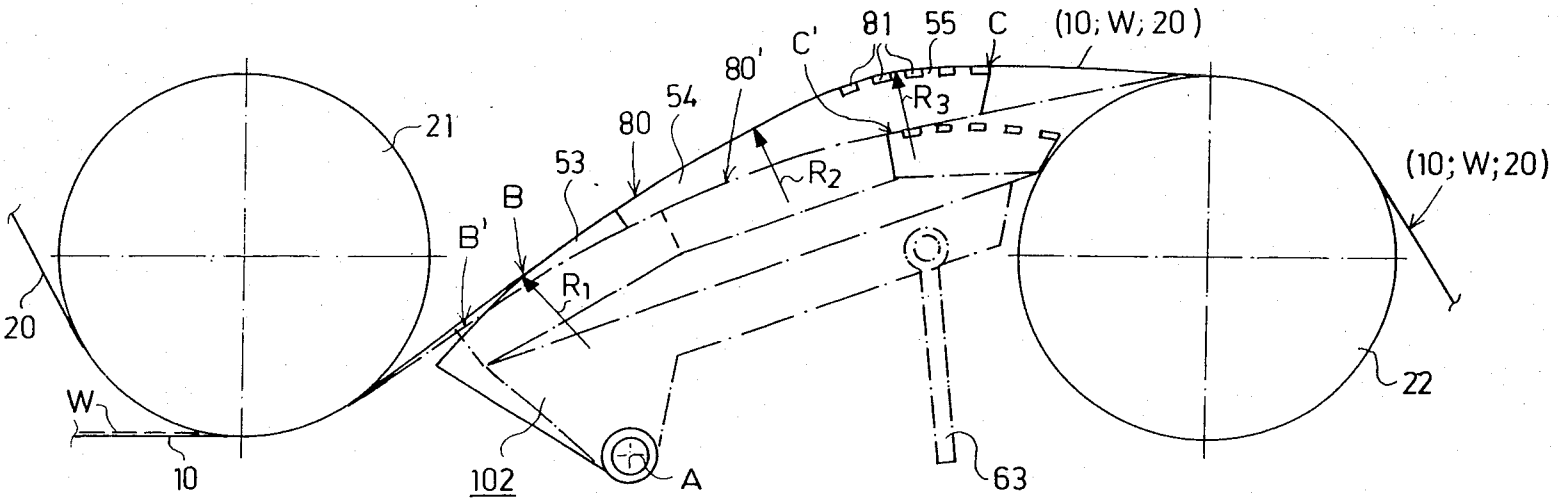
FIG. 2 is a schematic elevation view illustrating another embodiment of a forming shoe in accordance with the present invention, and showing the forming shoe in two different operating positions.

Referring now to FIG. 2, a forming shoe 102 constructed in accordance with the invention is disposed between forming rolls 21 and 22. The first forming roll 21 is situated within the upper wire loop 20 while the second forming roll 22 is situated within the lower wire loop 10. The curved guiding surface of the forming shoe 102 comprises a first or leading guiding surface portion 53, and immediately following second or intermediate guiding surface portion 54, and a third or trailing guiding surface portion 55 which immediately follows the second guiding surface portion 54. The guiding surface portion 53 comprises a solid-cover surface having a radius of curvature $R_1$ and the second guiding surface portion 54 also comprises a solid-cover surface having another radius of curvature $R_2$. The third or trailing guide surface portion 55 has the smallest radius of curvature $R_3$ and is formed by guide lists 81 having slits or gaps formed between them.

In accordance with the invention, the position and/or attitude of forming shoe 102 is adjustable and two possible positions thereof are illustrated in FIG. 2. In the solid line position, designated 80, the two-wire run extends between lines B and C, i.e., the active portion of the guiding surface comprises the segment B-C. The leading or entrance line B lies on the first guiding surface portion 53 while the trailing line C lies at the very ultimate or trailing edge of the shoe. In this position, the active portion of the guiding surface has both solid-cover as well as slitted or gapped surface characteristics. When the shoe is moved to the position designated 80', the entrance line B' is shifted forwardly, i.e., towards the leading edge of the forming shoe while the trailing line C' lies in the region between the second and third guiding surface portions 54 and 55. Thus, in the second position 80', the slotted third guide surface portion 55 formed by the lists 81 lies outside of the active portion of the shoe 102 and the active portion has only solid-cover characteristics.

The shoe 102 is pivotable about a horizontal axis A by means of arms 63 connected to movement activating means. The axis A may, furthermore, be mounted on slide means by which the shoe 102 may be displaced linearly such, for example, in two planes at right angles to each other.

Figure 3:
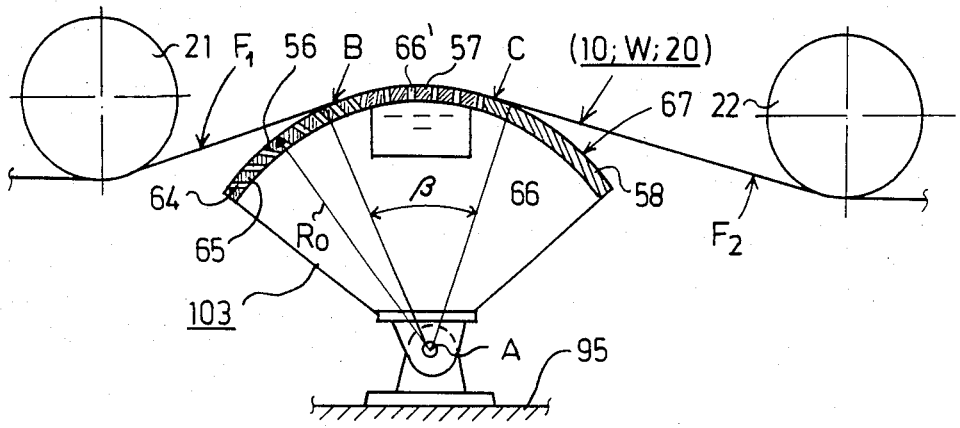
FIG. 3 is a schematic elevation view in partial section of still another embodiment of a forming shoe in accordance with the present invention, the forming shoe including three guiding surface portions having different surface quality.

Referring now to FIG. 3, a forming shoe 103 constructed in accordance with the invention is situated between forming rolls 21 and 22, both of which are situated within the upper wire loop 20. The curved guiding surface 56, 57 and 58 of forming shoe 103 has a constant radius of curvature $R_0$ and the forming shoe is mounted so as to be pivotable about a horizontal axis A. The axis A is located at the center of curvature of the curved guiding surface 56, 57, 58. It will thus be understood that the active portion $\beta$ of the curved guiding surface which extends between the lines B and C and over which the wires 10, 20 are guided remains constant regardless of the position of the shoe 103. However, the surface quality of the guiding surface may be controlled instead. Thus, the guiding surface of forming shoe 103 includes three different guiding surface portions 56, 57 and 58. The first guiding surface portion 56 is formed by transversely extending lists 65 spaced from each other to form slits 64 therebetween and into which water may escape. The second guiding surface portion 57 is provided with perforations 66' which are adapted to communicate with a suction box 66 provided within the shoe 103. The suction box 66 is connected to a suction system (not shown). The third guiding surface portion 58 comprises a solid cover 67. In the control position illustrated in FIG. 3, all three of the surface qualities are found within the active portion $\beta$, i.e., the entire perforated second guiding surface portion and segments of the first and third guiding surface portions remain within the sector $\beta$. However, it will be understood that the forming shoe 103 can be rotated about the axis A to vary the surface quality of the guiding surface located within the sector $\beta$.

The axle A may be mounted on a carriage which is arranged to be vertically and/or horizontally adjusted. Moreover, the forming shoe 103 of FIG. 3 has a rather wide range of adjustment of both dewatering capacity as well as web formation. Furthermore, the adjustment can be implemented so that the run of the two-wire portion 10, 20 does not change at all and the straight portions $F_1$ and $F_2$ remain unchanged in their direction and length.

Figure 4:
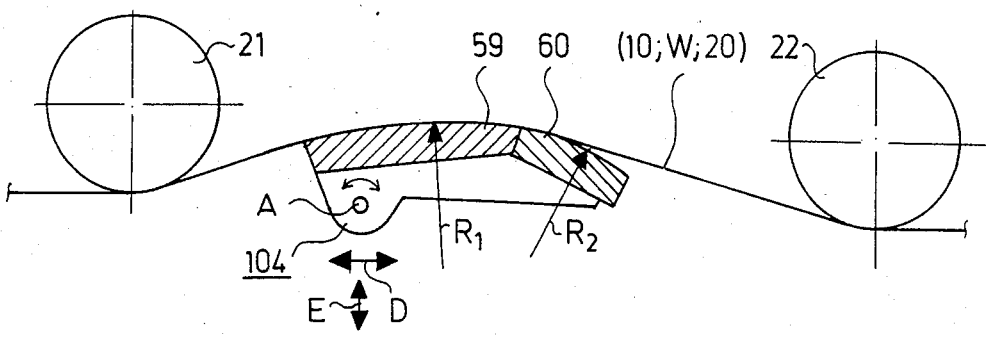
FIG. 4 is a schematic elevation view in partial section of still yet another embodiment of a forming shoe in accordance with the present invention, the forming shoe including two solid-cover guiding surface portions having different respective radii of curvature.

Referring to FIG. 4, a forming shoe 104 in accordance with the invention and which is substantially similar to the shoe 101 of FIG. 1 is illustrated. The curved guiding surface of shoe 104 includes two consecutive solid-cover guiding surface portions 59 and 60, the first portion 59 having a radius of curvature $R_1$ which is greater than the radius of curvature $R_2$ of the second guiding surface portion 60. The shoe 104 is mounted to be pivotable about an axis A which is arranged to be positionally adjustable both horizontally, designated by arrow D, and vertically, designated by arrow E.

Figure 5:
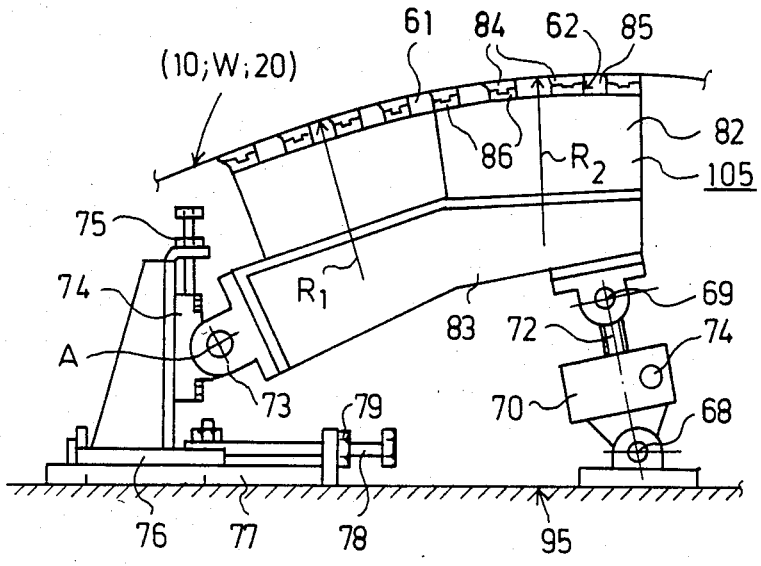
FIG. 5 is a schematic elevation view of yet another embodiment of a forming shoe in accordance with the present invention and showing one type of adjusting means.
Figure 6:
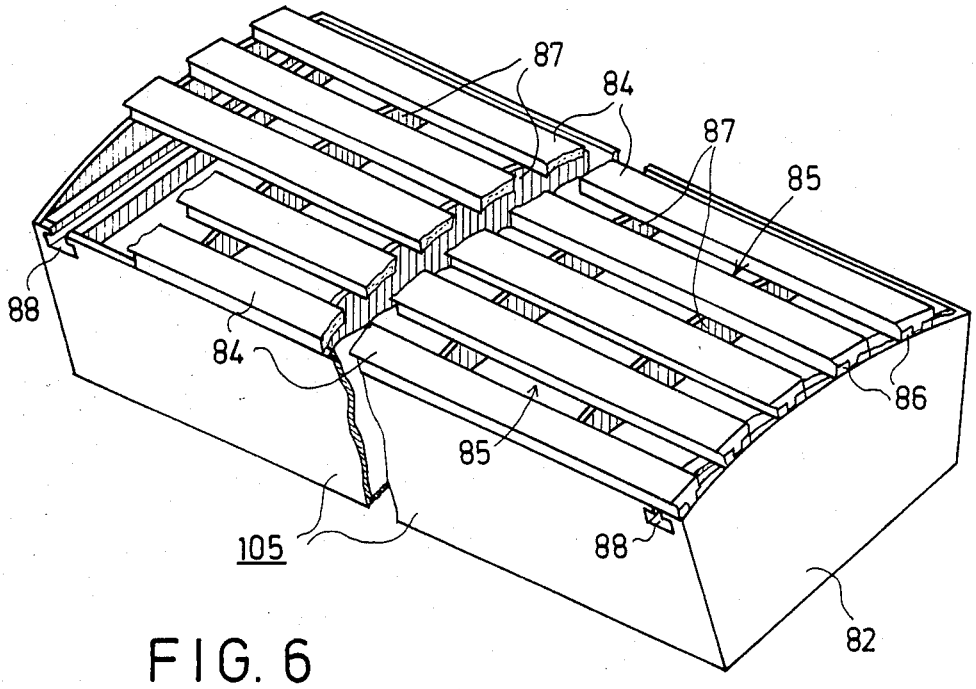
FIG. 6 is a perspective view, partially broken away, of the forming shoe illustrated in FIG. 5 and showing the construction of the curved guiding surface thereof.

Referring now to FIG. 5, a forming shoe 105 constructed in accordance with the invention is illustrated wherein the curved guiding surface is constituted by a first guiding surface portion 61 and an immediately following second guide surface portion 62, the guide surface portions 61 and 62 having different radii of curvature $R_1$ and $R_2$ respectively. Both of the guide surface portions are defined by lists 84 extending substantially transversely and mutually spaced from each other to define gaps 85 therebetween. As seen in FIG. 6, the lists 84 are affixed to the box or housing 82 of the shoe 105 as well as to intermediate beams 87. The lists 84 in the illustrated embodiment are fixed to the housing 82 and beams 87 by means of mating dove-tail portions 86 received in correspondingly shaped slots. Moreover, guide slots 88 extending in the machine direction are formed in the housing 82 which receive guide rods (not shown) forming a part of the frame 83 of the forming shoe so that the shoe is linearly displacable thereon.

Means for adjusting the location and attitude of the forming shoe 105 are also seen in FIG. 5. The means by which the shoe 105 is pivoted about the axis A comprises worm gear transmissions 70 disposed between the pivot shafts 68 and 69, the transmission 70 being operated through rotation of a shaft 71. Operation of the transmission 70 causes displacement of a rod 72 of the worm gear 70 which raises or lowers the trailing end of the shoe 105. The forward end of the frame part 83 of forming shoe 105 is attached by means of bearings 73 and an axle A to slides 74 which are mounted for vertical adjustment by screw means 75. The slides 74 are in turn connected with slides 76 which are mounted for horizontal movement in guides 77. The location of axle A can be adjusted in the horizontal direction by the slide means 76, 77 through the rotation of a threaded member 78 which cooperates with a lock nut 79. An extremely versatile adjustment of the attitude and position of the shoe 105 can be achieved through suitable adjustment of the means described above.

The forming shoes 101, 102, 104 and 105 described above comprise guiding surfaces having portions of different radii of curvature $R_1$, $R_2$ and $R_3$. These radii of curvature decrease in a stepwise fashion from the leading or entry edge region of the forming show towards the trailing edge thereof in the direction of travel of the web W. By such a stepwise decrease in the radii of curvature, a corresponding stepwise increase of the dewatering pressure is obtained through the generation of certain pulsations which have been found to have a favorable influence on web formation. It is also possible by providing a gradual increase in the dewatering pressure to boost or enhance the dewatering from the web through the mesh of one wire. In this connection, the forming shoe of the invention can be provided with a curved guiding surface having a radius of curvature which changes in a continuous manner, i.e., without marked jumps, such change preferably being a decrease in the direction of travel of the web. Such a guiding surface wherein the radius of curvature changes in a continuous manner can comprise either the entire or only a portion of the entire guiding surface of the forming shoe.

The dewatering of a web in a two-wire dewatering zone in accordance with the present invention will now be described in detail. When the web W arrives at the beginning of the two-wire forming section, it has already undergone a cautious initial dewatering phase through the wire 10 to obtain a suitable underside felting. Dewatering in the upward direction then begins over the sector $\alpha$ of the surface 21' of the open roll 21 under the effect of the pressure between the wires 10 and 20. This dewatering in the upward direction begins on the sector $\alpha$ in a very cautious manner and continues on the forming shoe 101 of the invention in an upward direction under the effect of centrifugal force resulting from the curvature $R_1$, $R_2$ of the shoe 101 and due to the tension between the wires 10 and 20. Further downward dewatering of the web occurs on the sector $\gamma$ of the roll 22 through the lower wire 10 or at least detachment of water from the mesh of the lower wire 10 occurs.

A more detailed description of the upper wire unit 45 of the forming section of FIG. 1 and its operation will now be described.

The upper wire unit 45 comprises a frame 90 to which the supporting means 32 for the first forming roll 21 are attached by means of horizontal pivot shafts 33. The open roll 21 is urged against the lower wire 10 by rods 34 which are displaced in the appropriate direction by means of worm gears 35. Water collecting means are provided after the forming roll 21 within the upper wire loop 20 in connection with the frame 90 for collecting water which has escaped in the region of the forming shoe 101 through the upper wire 20. Such means can comprise a save-all (not shown) in close cooperation with the forming shoe 101 and a save-all 36, the leading edge 30 of its bottom preferably being situated in the region of a horizontal plane which is tangential to the top of the shoe 101. The save-all 36 is suspended from the frame 90 by means of pivot axles 37 so that the save-all 36 can pivot about the axles 37 under the action of rods 38 operated by a worm gear 39. The rods 38 and gear 39 may be used to adjust the position of the front edge 30 to that most appropriate with a view towards water collection. The save-all 36 comprises appropriate devices and passages for draining water past the side of the paper machine. The water level in the save-all 36 is designated S.

The use of a forming shoe constructed in accordance with the invention, including the control of its position and attitude, enables extremely favorable relationships between the magnitude and succession of dewatering steps to be obtained. In particular, the dewatering pressures achieved at successive dewatering locations can be adjusted so as to be most favorable in view of both web formation as well as retention of fillers and fines so that optimum retention, web formation and an adjustable dewatering capacity for the particular paper brand being manufactured is possible. Moreover, these advantages are obtained by an apparatus having a relatively simple construction.

Examples of advantageous constructions of the various dewatering elements of the web forming section of the invention are now described. As noted above, the first forming roll 21 should be relatively open-faced so that dewatering can take place in an upward direction through the upper wire 20. The roll 21 may be either a grooved roll, a blind-drilled roll or a perforated roll. For example, the roll 21 may advantageously be formed by winding a profiled strip in a helical manner around a cylindrical core to provide an open roll surface. Preferably, the surface of the roll 21 constituted by grooves or openings constitutes at least about 50% of the entire surface. This open recessed surface roll 21 is preferably covered with a wire hose and has a suitable diameter in the range of about 600 to 1500 mm.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a two-wire section of a paper making machine comprising an integrated forming shoe mounted at a location and at an attitude and including curved guiding surface means having an active portion, said active portion being that portion of said curved guiding surface means over which a joint run of the wires and a paper web interposed therebetween is guided over a curved path of travel, said active portion having a length and surface characteristics, and wherein the web is dewatered as it passes over said guiding surface means at least in a direction away from said forming shoe at least in part due to the curved path of travel under the effect of centrifugal forces, the improvement comprising:

said guiding surface means of said integrated forming shoe includes at least two guiding surface means portions arranged in immediate succession in the direction of said path of travel of said joint run, said guiding surface means portions having different respective radii of curvature, and wherein said active portion of said curved guiding surface means includes a length of at least one of said at least two guiding surface means portions, means for adjusting at least one of the attitude and location of said integrated forming shoe in its entirety to change said active portion of said curved guiding surface means over which the joint run of the wires and interposed web is guided to selectively provide which of said at least two guiding surface means portions of different radii of curvature and the lengths thereof are included in said active portion.

2. The combination of claim 1 wherein said radii of curvature of said guiding surface means decrease from a leading edge region of said forming shoe towards a trailing edge region thereof.

3. The combination of claim 2 wherein said radii of curvature decrease in a continuous manner.

4. The combination of claim 2 wherein said radii of curvature decrease in a step wise manner.

5. The combination of claim 1 wherein said at least two guiding surface means portions include at least two guiding surface means portions having different respective surface characteristics, and wherein said forming shoe adjusting means selectively provides which of said at least two guiding surface means portions of different radii and lengths thereof and surface characteristics are included in said active portion.

6. The combination of claim 5 wherein said guiding surface means of said forming shoe includes a forward portion and subsequent portion following said forward portion, and wherein said forward portion of said guiding surface means includes at least two guiding surface means portions having surface characteristics defined by solid cover guiding surfaces having respective radii of curvature which decrease in the directions of said path of travel of said joint run, and wherein said subsequent portion of said guiding surface means includes at least one guiding surface means portion having surface characteristics defined by transversely extending guiding lists mutually spaced from each other to define open slits between them, said at least one guiding surface means portion of said subsequent portion having a radius or curvature which is smaller than the radii of curvature of said guiding surface means portions of said forward portion.

7. The combination of claim 6 wherein said respective radii of curvature of said at least two guiding surface means portions of said forward portion decrease in a continuous manner.

8. The combination of claim 6 wherein said respective radii of curvature of said at least two guiding surface means portions of said forward portion decrease in a stepwise manner.

9. The combination of claim 1 wherein said curved guiding surface means of said forming shoe are defined by an envelope described by a plurality of transversely extending foil-like guiding lists mutually spaced from each other defining open slits between them.

10. The combination of claim 9 wherein said envelope has a radius of curvature which changes in a stepwise manner in the direction of travel of said joint run.

11. The combination of claim 9 wherein said envelope has a radius of curvature which changes in a substantially continuous manner in the direction of travel of said joint run.

12. The combination of claim 1 wherein said curved guiding surface means of said forming shoe comprises at least two solid cover guiding surfaces having respective radii of curvature.

13. The combination of claim 12 wherein said respective radii of curvature of said solid cover guiding surfaces change in a stepwise manner.

14. The combination of claim 12 wherein said respective radii of curvature of said solid cover guiding surfaces change in a continuous manner.

15. The combination of claim 5 wherein said at least two guiding surface means portions include at least three guiding surface means portions having respective surface characteristics defined by mutually spaced transversely extending guide lists, a guide surface having perforations formed therethrough and a smooth solid-cover surface.

16. The combination of claim 1 wherein said forming shoe adjusting means comprise means for moving said forming shoe in at least one of a pivoting movement with respect to a horizontal axis, a linear movement in a substantially horizontal direction, and a linear movement in a substantially vertical direction.

17. The combination of claim 16 wherein said forming shoe adjusting means comprise worm gear transmission means mounted between a frame component of said forming section and a frame component of said forming shoe for pivoting said shoe with respect to a horizontal axis.

18. The combination of claim 16 wherein said forming shoe adjusting means comprise slide means for adjusting at least one of the location and attitude of said forming shoe by which the position of said forming shoe is adjustable in at least one of the vertical and horizontal planes.

* * * * *